US009044627B1

(12) United States Patent
Williams et al.

(10) Patent No.: US 9,044,627 B1
(45) Date of Patent: Jun. 2, 2015

(54) BACK WALL FIRE SUPPRESSOR SYSTEM AND METHOD

(75) Inventors: Brent W. Williams, Fort Worth, TX (US); Michael R. Stevens, Benton, AR (US); Preston N. Weintraub, Keller, TX (US); Donald W. Murray, Arlington, TX (US)

(73) Assignee: WilliamsRDM, Inc., Fort Worth, TX (US)

( * ) Notice: Subject to any disclaimer, the term of this patent is extended or adjusted under 35 U.S.C. 154(b) by 1173 days.

(21) Appl. No.: 12/417,607

(22) Filed: Apr. 2, 2009

(51) Int. Cl.
*A62C 3/00* (2006.01)
*A62C 37/12* (2006.01)

(52) U.S. Cl.
CPC ..... *A62C 3/006* (2013.01); *A62C 37/12* (2013.01)

(58) Field of Classification Search
CPC ..... A62C 3/006
USPC ..... 169/57, 59, 65, 29, 38, 42; 239/222.11, 239/223, 263.3–265, 68, 669, 681, 683, 239/684, 687, 689
See application file for complete search history.

(56) References Cited

U.S. PATENT DOCUMENTS 1,208,548 A * 12/1916 Haller ..... 169/29
1,451,915 A * 4/1923 Ladd-Davis ..... 169/29
3,040,815 A 6/1962 Pambello
3,209,837 A 10/1965 Freedman
3,773,111 A 11/1973 Dunn
3,884,307 A 5/1975 Williams
3,897,828 A 8/1975 Glover
3,918,526 A 11/1975 Hattori
4,011,911 A * 3/1977 Gow ..... 169/29
4,113,020 A 9/1978 Panetta
4,964,469 A 10/1990 Smith
5,351,760 A 10/1994 Tabor
5,518,075 A 5/1996 Williams
5,628,367 A 5/1997 Truax et al.
5,868,205 A 2/1999 Cunningham et al.
5,871,057 A 2/1999 Stehling et al.
5,881,819 A 3/1999 Walters et al.
5,899,278 A 5/1999 Mikulec
6,029,751 A 2/2000 Ford et al.
6,105,677 A 8/2000 Stager
6,244,353 B1 6/2001 Greer
6,276,461 B1 8/2001 Stager
6,702,208 B1 * 3/2004 Hadler et al. ..... 239/668
6,796,382 B2 9/2004 Kaimart
7,182,143 B2 2/2007 Hall et al.

* cited by examiner

*Primary Examiner* — Christopher Kim
(74) *Attorney, Agent, or Firm* — Morani Patent Law, PC

(57) ABSTRACT

An automatic self-contained fire suppression system and method are provided herein. Stovetop fires are a well known residential and commercial hazard. The fire suppression system described mounts on a back wall or back splash above the stove mount. By mounting on the back wall, the system is free from interconnections with apparatus mounted above the stovetop, such as hoods, microwave ovens, lights, fans, and vents. Using a hopper containing fire suppressing matter, a power spring, drive shaft, and a bladed spinner, fires suppressing powder is distributed over the stovetop surface. The fire suppression action is triggered automatically via failure of a heat sensitive frangible link.

7 Claims, 15 Drawing Sheets

BACK WALL FIRE SUPPRESSOR SYSTEM AND METHOD

FIELD OF THE INVENTION

The present invention relates to a method and system of fire suppression, and more particularly to automatic stovetop fire suppression.

BACKGROUND OF THE INVENTION

Stovetop fires are a well known residential and commercial hazard. An unattended stovetop fire, for example a grease fire, can cause damage to nearby appliances and cabinets. Worse, stovetop fires can lead to structural damage or injury. Because the propensity for stovetop fires is so pervasive, an efficient means of automatic fire suppression is desired. Even if a stovetop fire is attended, an automatic extinguishing method may be more effective and expedient compared to manual means.

A number of conventional automatic stovetop fire extinguishers, which mount above the stovetop surface, are available. These include: U.S. Pat. No. 6,276,461 to Stager; U.S. Pat. No. 6,105,677 to Stager; U.S. Pat. No. 5,899,278 to Mikulec; U.S. Pat. No. 5,518,075 to Williams; and U.S. Pat. No. 3,884,307 to Williams. The array of conventional fire suppression systems vary from pendulum swing apparatus (Stager '461), to canister systems (Williams '307 and Stager '677), or to tube connecting systems for liquid effluent (Mikulec). The mounting mechanism for these systems similarly vary from interconnected tubing (Mikulec) to pendulum anchors (Stager '461), to bolts (Stager '677), or to magnets (Williams '307 and Williams '075).

The difficulty of installation of these systems varies considerably but all require attachment over the stovetop surface. Development of a universal over the stovetop mounting method presents a challenge for multiple reasons, which may include the complexity of the fire suppression system and the type and shape of range hood. Design of a universal over the stovetop mounting can be further complicated by vents, fans, lighting, microhoods, and microwave ovens all of which vary and are commonly found above a stovetop. It may be difficult to install an automatic fire suppression system into an existing hood and/or microwave configuration, in fact, it may not be possible without impinging the function of lights and vents.

Conventional stovetop fire suppression systems are designed to be housed within the hood. Depending on the configuration of either a hood or a microwave-ventilation combination, concealment may not be possible. Lack of the ability to conceal conventional stovetop fire suppression systems may result in their not being installed or in their removal, which leaves the residents and owners vulnerable to stovetop fire conditions. A complicated installation method can also lead to lower utilization of the automatic fire suppression product. An automatic stovetop fire suppression system which could be universally mounted irrespective of the overhead stovetop configuration, would be desirable. A system and method of stovetop fire suppression, which is readily mountable is desirable, at least in part, to encourage use of the same.

A system and method of stovetop fire suppression, which can be installed at a height and in a position that is independent of an overhead hood or appliance may provide a more effective fire suppression. A fire suppression system which affords mounting independent of the apparatus above the stove could yield an effective fire suppression system for various stovetop configurations. Such mounting, independent of above stovetop appliances, cabinets, and hoods, may also simplify installation.

SUMMARY OF THE INVENTION

The present invention addresses some of the issues presented above by providing a system and method of stovetop fire suppression, which mounts on the back wall of a stovetop area. The back wall mounting, in accordance with the present invention is compatible with many hood, venting, lighting, and microwave configurations. Further, a back wall fire suppressor, in accordance with the present invention, is readily mountable on an unencumbered back wall.

An aspect of the present invention is to provide an automatic stovetop fire suppression system, which does not interfere with overhead lighting.

Another aspect of the present invention is to provide an automatic stovetop fire suppression system, which does not interfere with overhead vents or fans.

Another aspect of the present invention is to provide an automatic stovetop fire suppression system, which does not interfere with above the stove microwave ovens.

Another aspect of the present invention is to provide an automatic stovetop fire suppression system, which can be used for stovetops that back near a wall or have a back splash, irrespective of overhead apparatus.

Another aspect of the present invention is that it provides user friendly mounting on an upright flat surface with open view installation.

Another aspect of the present invention is that it is self contained and requires no interconnection with tubing, appliances, or hoods.

Another aspect of the present invention is that it can suppress an oil fire on any burner from the back wall.

Embodiments of the present invention may employ any or all of the exemplary aspects above. Those skilled in the art will further appreciate the above-noted features and advantages of the invention together with other important aspects thereof upon reading the detailed description that follows in conjunction with the drawings.

BRIEF DESCRIPTION OF THE FIGURES

For more complete understanding of the features and advantages of the present invention, reference is now made to the detailed description of the invention along with the accompanying figures, wherein.

DETAILED DESCRIPTION OF THE INVENTION

The invention, as defined by the claims, may be better understood by reference to the following detailed description. The description is meant to be read with reference to the figures contained herein. This detailed description relates to examples of the claimed subject matter for illustrative purposes, and is in no way meant to limit the scope of the invention. The specific aspects and embodiments discussed herein are merely illustrative of ways to make and use the invention, and do not limit the scope of the invention.

Figure 1A:
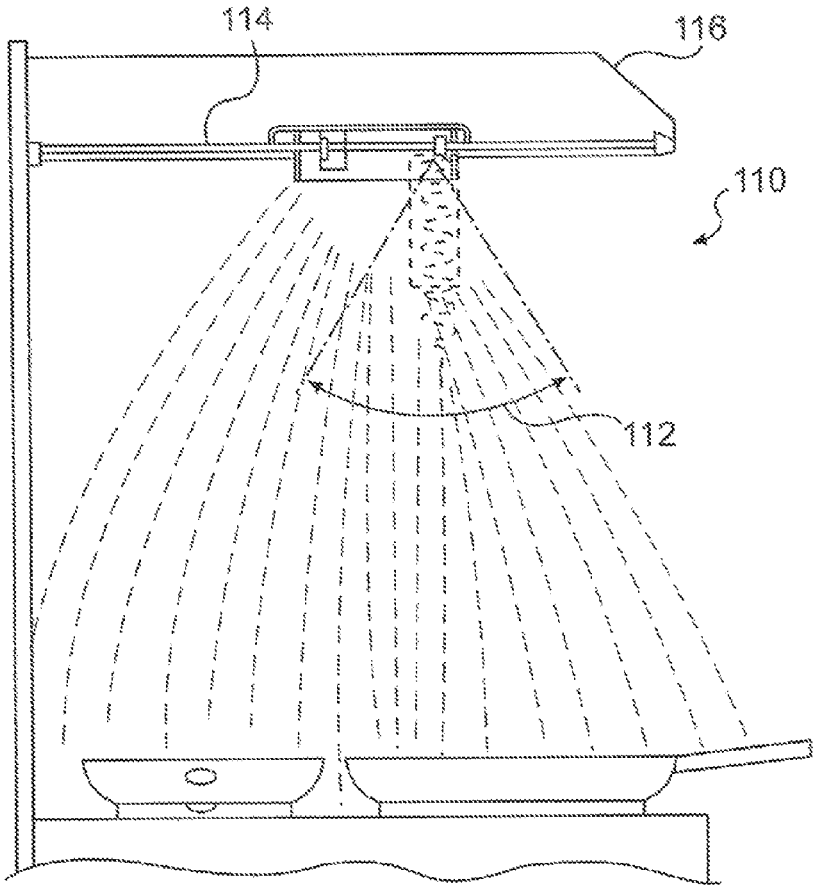
FIG. 1A PRIOR ART
FIGS. 1A-1D show conventional fire suppression systems, which are mounted overhead of the stove cooking surface.
Figure 1B:
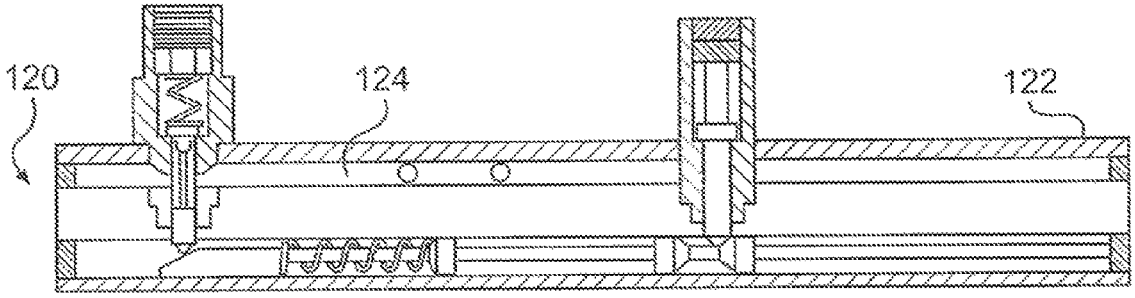
FIG. 1B PRIOR ART

FIGS. 1A-1D show conventional fire suppression systems, which are mounted overhead of the stove cooking surface. Each of the conventional fire suppression systems are shown mounted under a hood. FIG. 1A shows a conventional pendulum 112 system which has a pivotal mount and members 114 spanning the depth of the hood 116. FIG. 1B shows a cross section of a hood 122 with tubes 124 of a fire suppression system comprising fluid tubing and valves 120. Each of these systems is mounted at a height which depends on the height of the hood. Each system is also fitted into the interior of the hood. Variations in installation and mounting height are inevitable with both systems. Systems 110 and 120 are also fairly extensive and interfacing with, or rather avoidance of, existing hood vents, fans, and lighting will likely complicate the installation. Depending on the configuration of apparatus under the hood, systems 110 and 120 may not be compatible with the hood and proper installation may not be possible.

Figure 1D:
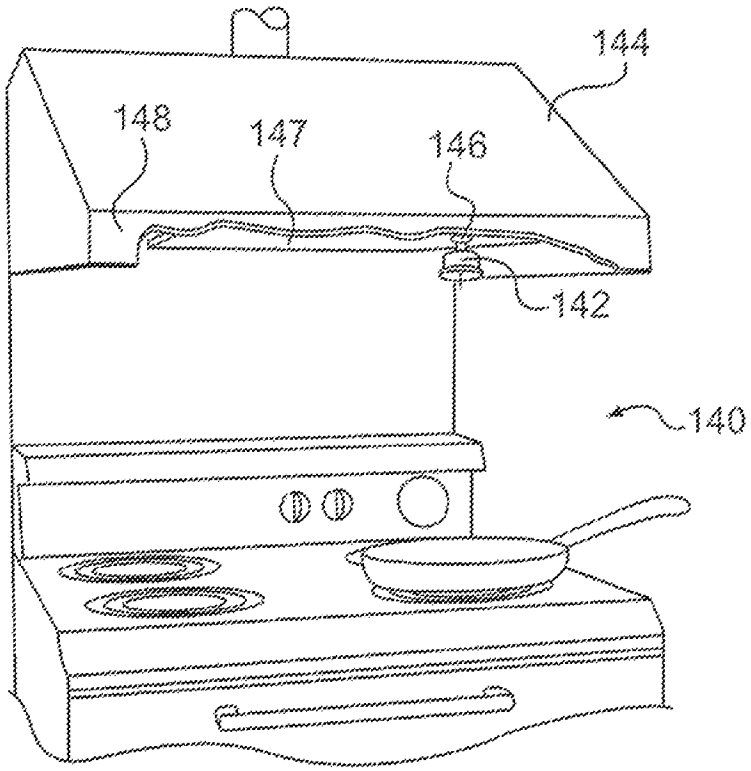
FIG. 1D PRIOR ART
Figure 1C:
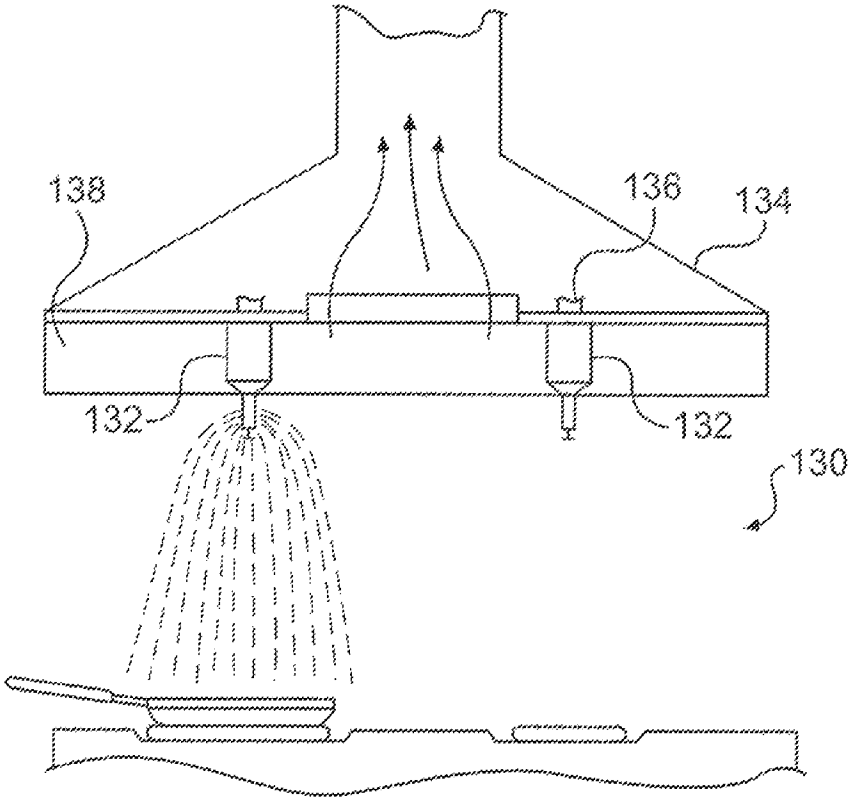
FIG. 1C PRIOR ART

Systems 130 and 140, shown in FIGS. 1C and 1D, respectively, are self contained and offer simpler installation. Canister 132 is bolt mounted 136 and canister 142 is magnet mounted 146. Each canister mounts underneath its respective hood, 134 and 144. The front rim of FIG. 1C is not shown but runs parallel to the back rim 138. Similarly, Front rim 148 is shown cutaway to show the mounted canister and existing hood apparatus fan 147. Like systems 110 and 120, systems 130 and 140 are mounted at the height of the hood. And like systems 110 and 120, the self contained canister systems mount under the hood where compatibility with existing fans, vents and lighting is desired, such that the positioning of the canister may be determined not by the fire suppression system design but, rather by free space under the hood.

Figure 2A:
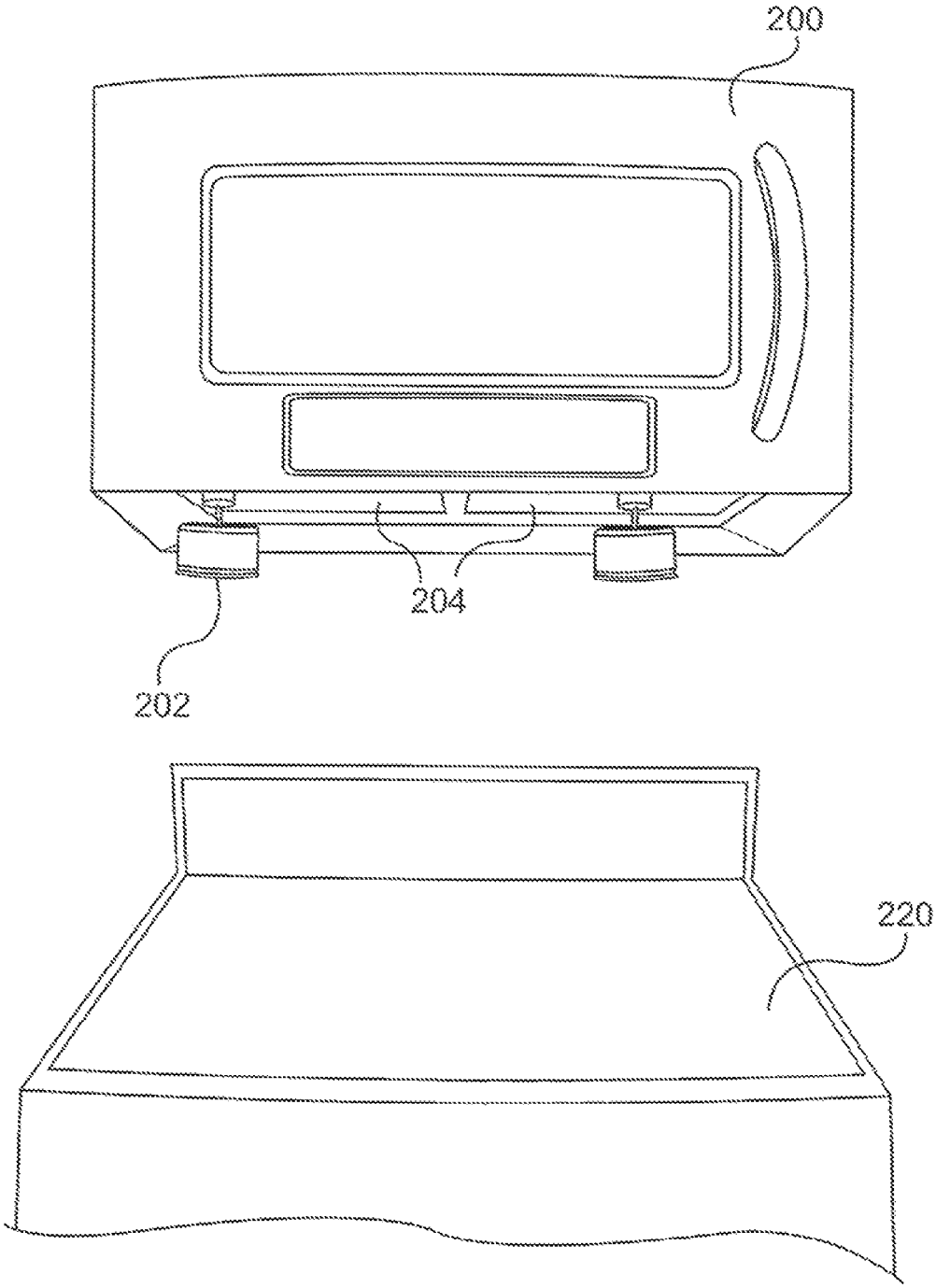
FIG. 2A PRIOR ART
FIGS. 2A-2B show a front and bottom perspective view, respectively, of an over the stovetop microwave configuration.
Figure 2B:
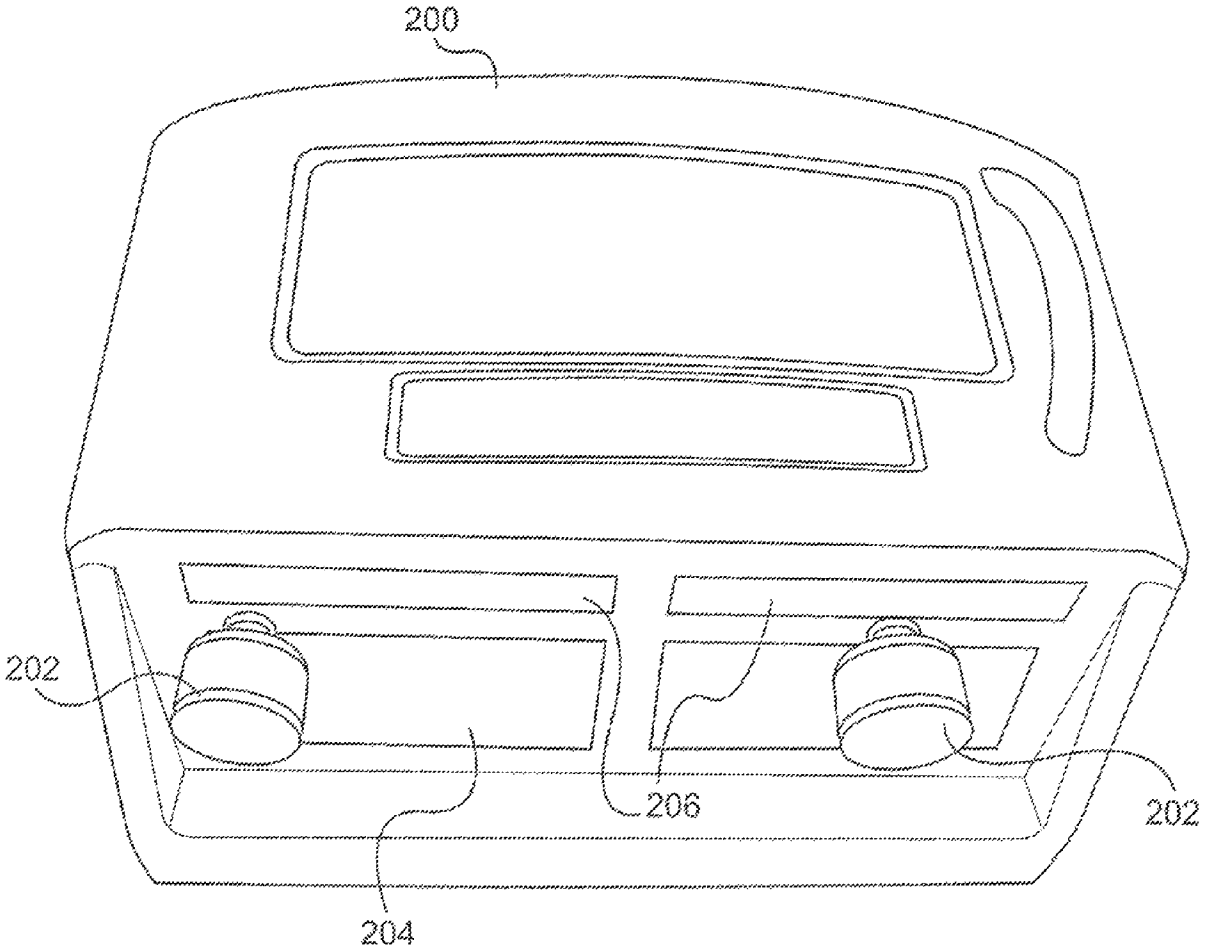
FIG. 2B PRIOR ART

Referring to FIG. 2A, when an above stove microwave is present, compatibility with conventional fire suppression systems may be significantly limited. Conventional above stove microwave systems utilize a venting system and lack a traditional hood. The microwave 200 has a vent system 204 but lacks a hood configuration. A pair of vents 204 with fans, not shown, are built into the underside of the microwave 200. Fire suppression system canisters 202 are mounted just in front of the vents 204. FIG. 2B shows a bottom perspective view of the over the stove microwave 200. Canisters 202 are mounted just between lights 206 and vents 204. As seen from the view of FIG. 2B, microwave 200 lacks a hood enclosure on its bottom side, with the lights 206 and vents 204 being flush with the bottom edge of the microwave. Fire suppression canisters 202 have limited mountable space available and are not housed under a hood.

Figure 3:
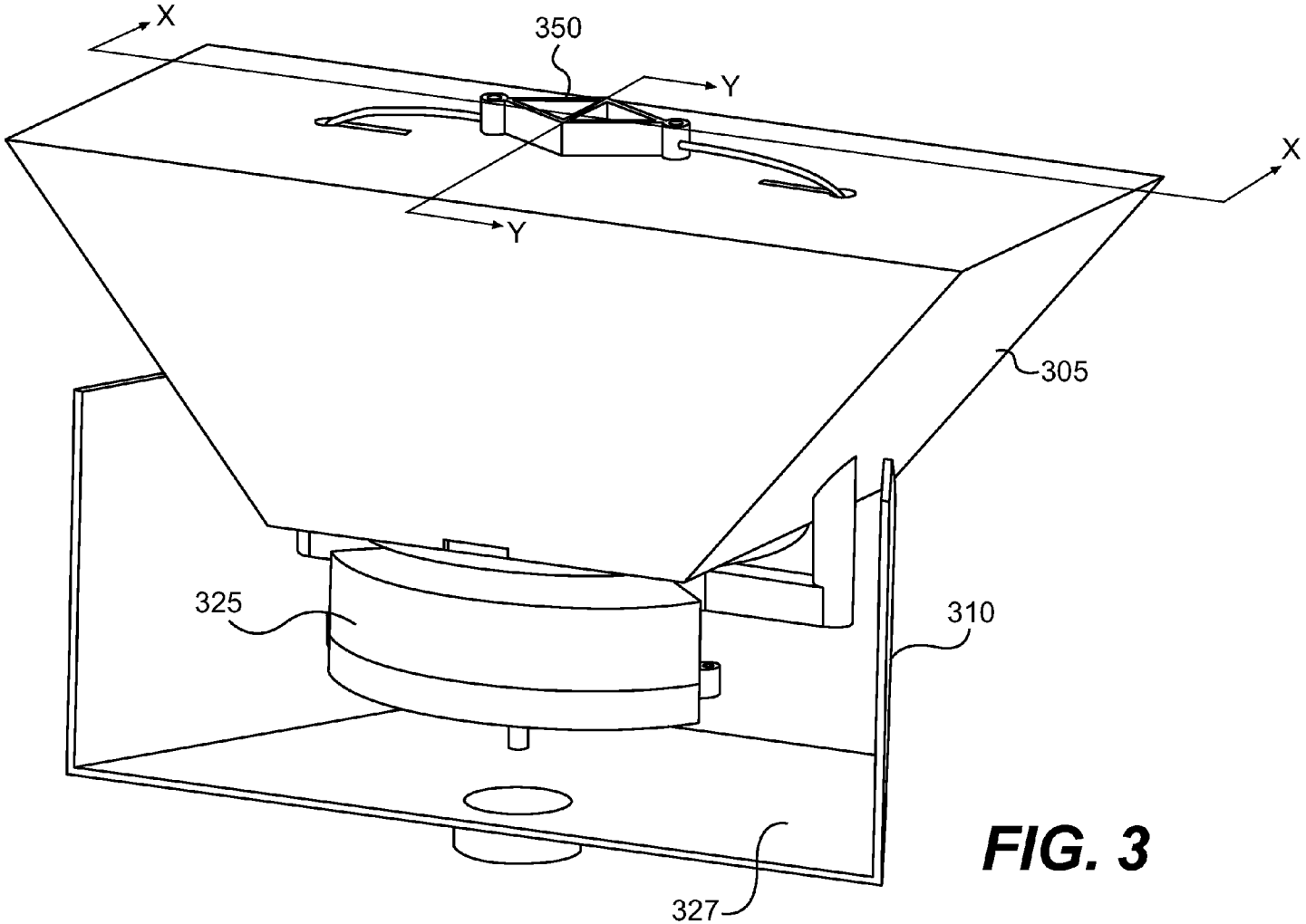
FIG. 3 shows a front perspective view of a back will fire suppressor system in accordance with an embodiment of the present invention.
Figure 5:
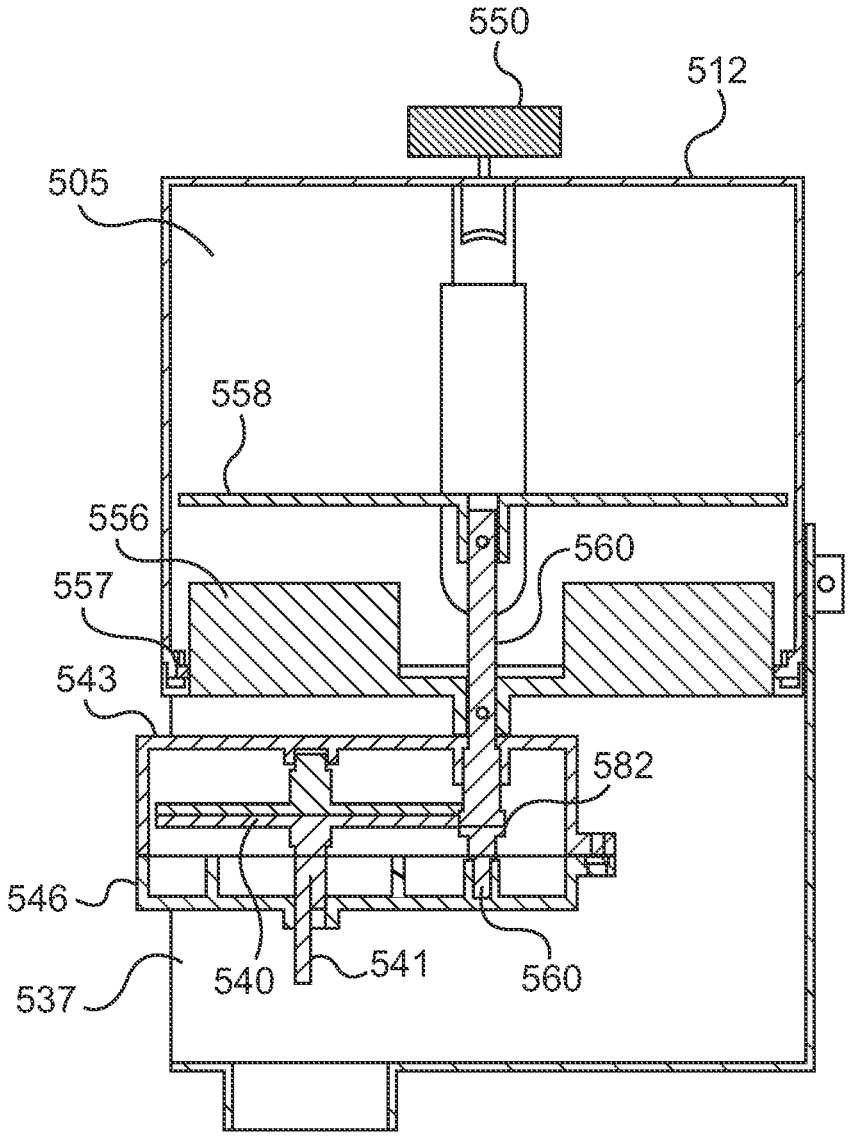
FIG. 5 shows a cross section along line Y-Y of FIG. 3 of an exemplary embodiment of a back wall fire suppressor in accordance with an embodiment of the present invention.
Figure 6:
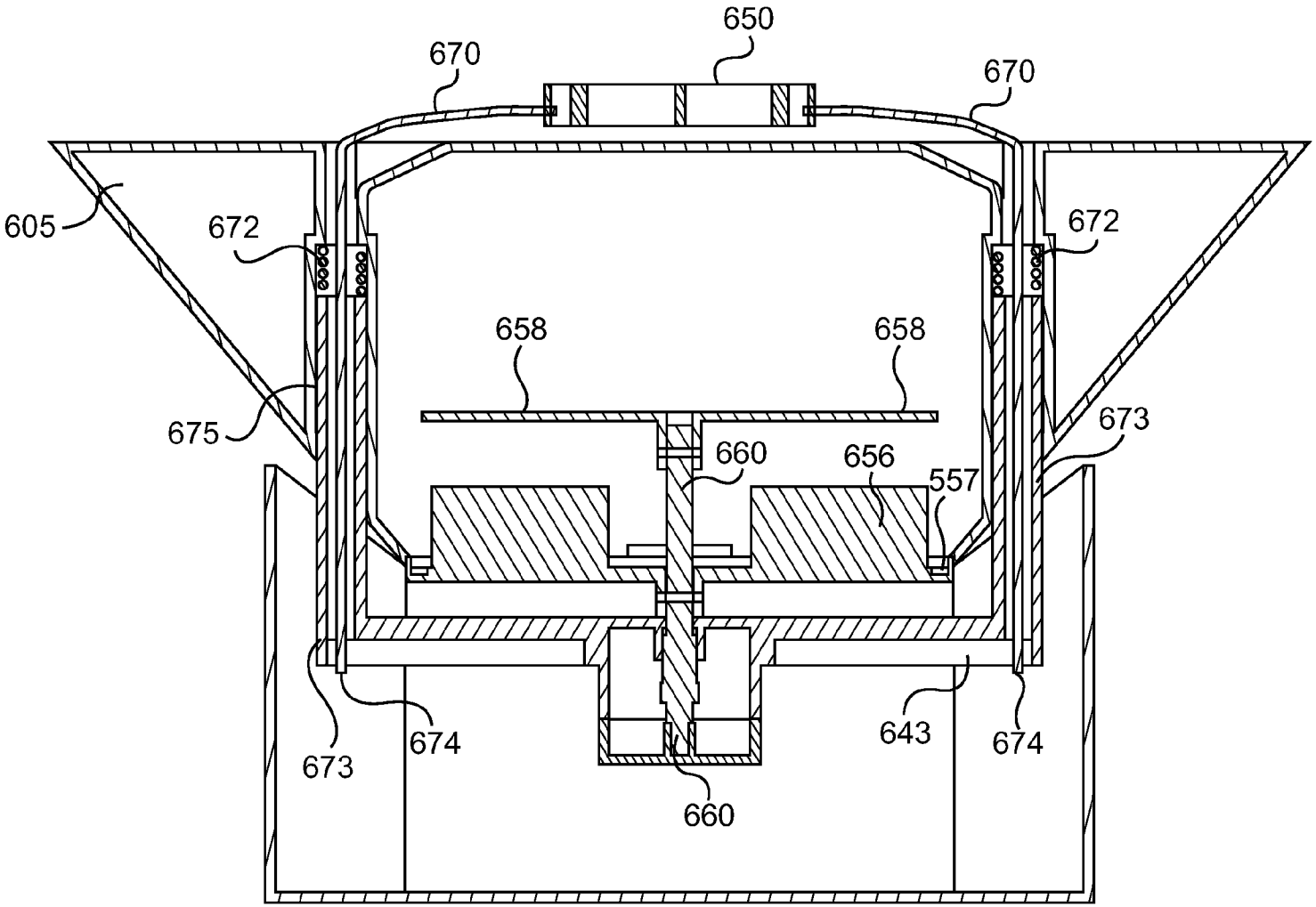
FIG. 6 shows a cross section along line X-X of FIG. 3 of an exemplary embodiment of a back wall fire suppressor in accordance with an embodiment of the present invention.

FIG. 3 shows a perspective view of a hopper 305 and a cutaway view of a front of a base 310 of a back wall fire suppressor system in accordance with an exemplary embodiment of the present invention. Hopper 305 comprised fire suppressing matter, for example, sodium bicarbonate. Attached to the hopper is base 310, which houses, a gear box 325. When the back wall fire suppressor system is mounted, plane X-Y is the top face. Section views along lines Y-Y and X-X are shown in FIGS. 5 and 6, respectively. A frangible link 350 runs across the top face. In accordance with one exemplary embodiment, frangible link 350 may comprise a bulb which fractures when it senses a threshold temperature. Any thermally activated self releasing mechanism may be incorporated into a back wall fire suppressor system, in accordance with the present invention. In another embodiment, link 350 is made from an alloy that yields or fails at a desired threshold temperature. In accordance with yet another embodiment a thermo bulb link, for example a THERMO BULBALINK (JOB GmbH, Hamburg, Germany), may be used. Still other embodiments may include a solder based fuse link, a pyrotechnic device, an intumescent actuator, or a shape-memory alloy based link mechanism.

FIGS. 4A-4D show top, back, side, and front views, respectively, of a back wall fire suppressor in accordance with an exemplary embodiment of the present invention. Turning to top view, FIG. 4A, an exemplary link 450 is connected to a metal line 452, which connects on each side to a respective cable 454. Each cable 454 passes through an opening 455 in the face plate 412 of the hopper 405. In alternate embodiments, link 450 attaches to a lanyard and the lanyard extends into the hopper as described below. In still other embodiments, a cable is used with or without in line springs.

Figure 4A:
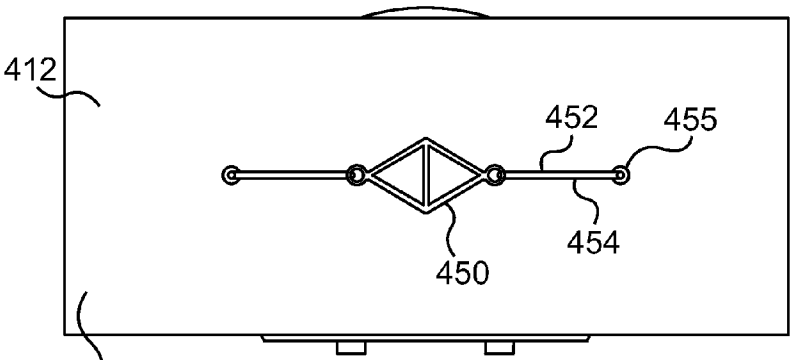
FIGS. 4A-4D show top, back, side, and front views, respectively, of a back wall fire suppressor in accordance with an exemplary embodiment of the present invention.
Figure 4B:
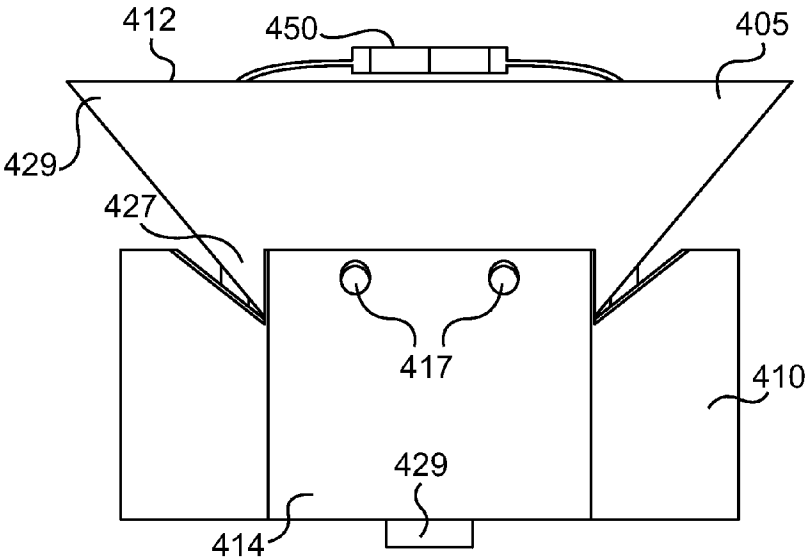

A back view of an exemplary embodiment, FIG. 4B, shows a diffuser shaped hopper from the base 410 to the top of the hopper covered by face plate 412. In an alternate embodiment, not shown, the hopper is convex from a base point 427 to a discharge point 429. And in yet another embodiment, the hopper is concave moving from base point 427 to discharge point 429. While the front view, FIG. 4A, shows a rectangular hopper top face, in other exemplary embodiments, the top face of the hopper may be square, round, rounded, and the length width orientation of the face plate may be reversed. In still other embodiments, the hopper cross section is constant from its top to bottom. The base 410 is affixed to a mounting plate 414. Also shown are two holes 417 for securing the mounting plate 414 to the back wall or back splash. In alternate embodiments, the base, for example 410, may be secured to a back surface by other mechanisms to include a bracket affixed to the back wall or back surface, which receives the base, a backside of the hopper, or a combination thereof. In other embodiments, other mounting mechanisms may be used, for example, structural tape may provide the mechanism for affixing the back wall fire suppressor to a back surface above the stove top.

Figure 4C:
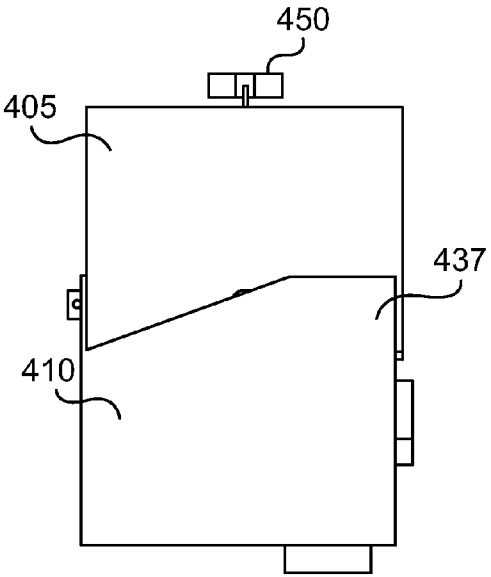

As can be seen from an exemplary side view, FIG. 4C, the base 410 extends higher on the hopper on the back side 437. In alternate embodiments, the base, like the hopper can be rounded. The orientation of the frangible link 450 can vary in alternate directions, perhaps 90 degrees off of its direction shown in FIGS. 4A-4C, across different embodiments. Further the frangible link 450 may be mounted on a front face of the hopper or a bottom of a face.

Figure 4D:
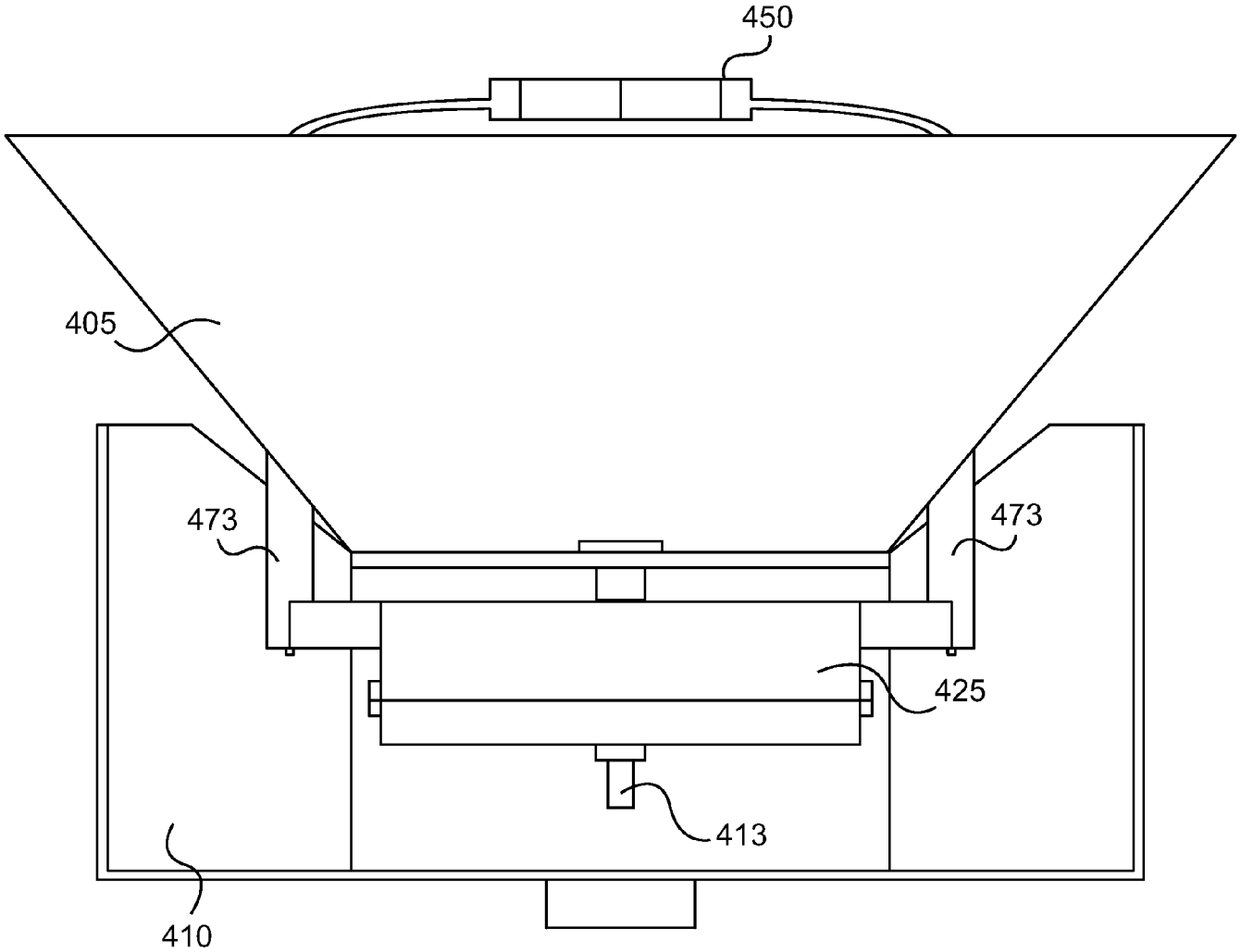

FIG. 4D shows a front face of an exemplary embodiment of the present invention. The base 410 is open in the front, and the gear box 425 can be seen. Conduits 473 are affixed to the gear box 425 and extend up into receiving conduits, not shown, in the hopper.

FIG. 5 shows a cross section along line Y-Y of FIG. 3, of an exemplary embodiment of a back wall fire suppressor in accordance with an embodiment of the present invention. A spur gear 540 is housed within a top 543 and bottom gear box housing 546. The spur gear 540 engages pinion gear 582. A pinion gear 582 meshes with and is driven by the spring loaded spur gear 540 and turns a spinner 556 and an agitator 558 via its pinion shaft 560. Spur gear 540 has a shaft 541 for twisting and loading a power spring, which provides the driving force for turning the pinion shaft 560. In accordance with the embodiment of FIG. 5, spur and pinion gears spin in opposite directions during both loading and unloading of the power spring.

Agitator 558 assists in the flow of fire suppressing material from within the hopper housing onto the spinner 556. Spinner 556 propels the fire suppressing material, for example sodium bicarbonate, from the back wall to cover the stovetop. Spinner 556 and seal 557 enclose the opening of hopper 505. An embodiment of the spinner and seal are shown in greater detail in FIG. 7A.

FIG. 6 shows a cross section along line X-X of FIG. 3, of an exemplary embodiment of a back wall fire suppressor in accordance with an embodiment of the present invention. Lanyards or cables 670 are attached to each end of a frangible link 650. These lines extend down through conduits 673 and are secured 674 to a top portion of the gear box 643. The gearbox assembly comprises two cylindrical conduits 673 that slide within receiving cylinders 675 comprised in the hopper 675. Springs 672 compress when the gear house conduits 673 are in the up position and lines 670 are taunt. As shown in FIG. 5, pinion gear shaft 660 rotates the spinner 656 and the agitator 658. The entire gearbox, shown for example in FIG. 3 325, slides up and down with the gear box conduits 673 in the receiving cylinders 672 of the hopper. The lines 670 also thread through the compressed springs 672. Upon breaking of the link 650 as lines 670 loosen, compressed springs 672 expand assisting in displacement of conduits 673 from receiving cylinders 675, and lowering the gear box. The gear box 325 can be displaced or lowered to a bottom shroud, shown for example in FIG. 3, 327, when the link fails.

Figure 7A:
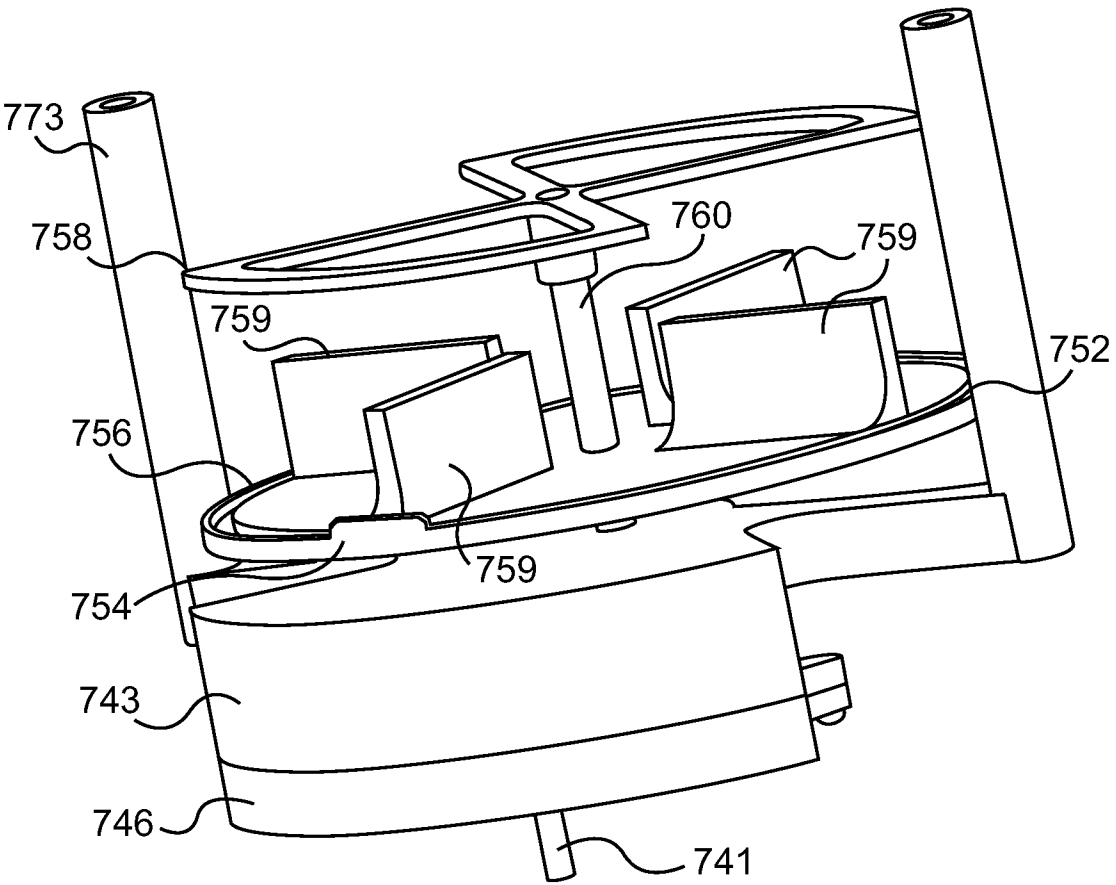
FIGS. 7A-7B show a front perspective view of a spinner assembly and a bottom perspective view of a spinner assembly, respectively, in accordance with an exemplary embodiment of the present invention.
Figure 7B:
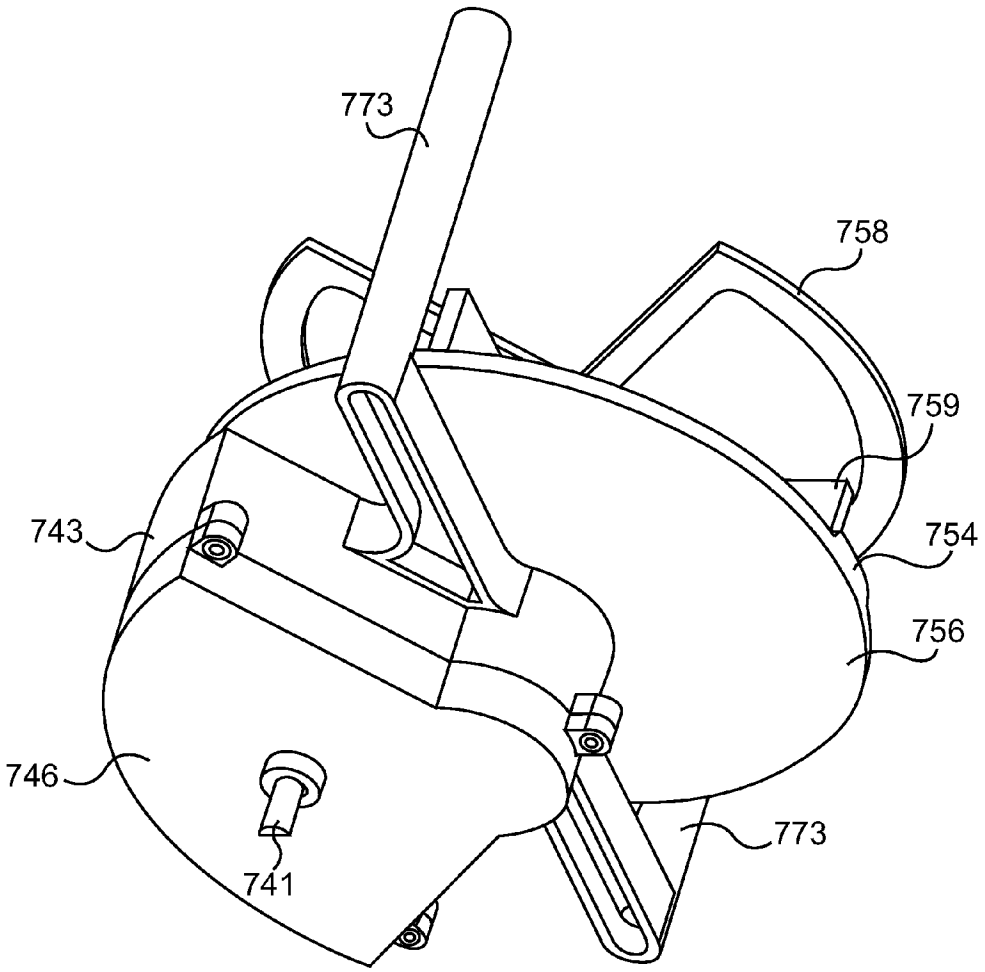

FIGS. 7A-7B show a front perspective view of a spinner assembly and a bottom perspective view of a spinner assembly, respectively, in accordance with an exemplary embodiment of the present invention. The spinner 656 and seal 652 are shown in the up position in FIG. 6, only that portion of the gear box comprising pinion shaft 660 is shown. When the gearbox and spinner are in the up position, the spinner 656 and an elastomer-type seal 652 close the bottom of the hopper 605. The interface of the spinner 756 and the seal 752, which contact the bottom of the hopper, are shown more particularly in the exemplary embodiment of FIG. 7A. In accordance with an exemplary embodiment of the present invention, the seal 752 may be compressible, rubber, elastomeric, polymeric, or other composite.

When the spinner 756, 656 is in the up position, as shown in FIG. 6, tabs or stops 770, as shown in FIG. 7A, keep the spinner from rotating. According to an exemplary embodiment, tabs 754 on the spinner engage receiving pockets, not shown, in the hopper 605, shown in FIG. 6, when the spinner is in the up position. Turning the spur shaft 741, loads a power spring, not shown. If the power spring is under load, twisted, coupling of the spinner to the hopper stops the spinner from rotating when the spur shaft is released. By dropping the spinner mechanism down, the tabs 754 disengage the pockets in the hopper and the spinner 756 begins to rotate, releasing the potential energy in the power spring, which may also be called a clock spring. As shown in FIGS. 7A-7B, the spinner comprises multiple blades 759. In accordance with one exemplary embodiment, there are four blades. The agitator 758 acts to break up the fire suppressing matter and keep the matter flowing down into the spinner 756 when it drops.

Figure 8:
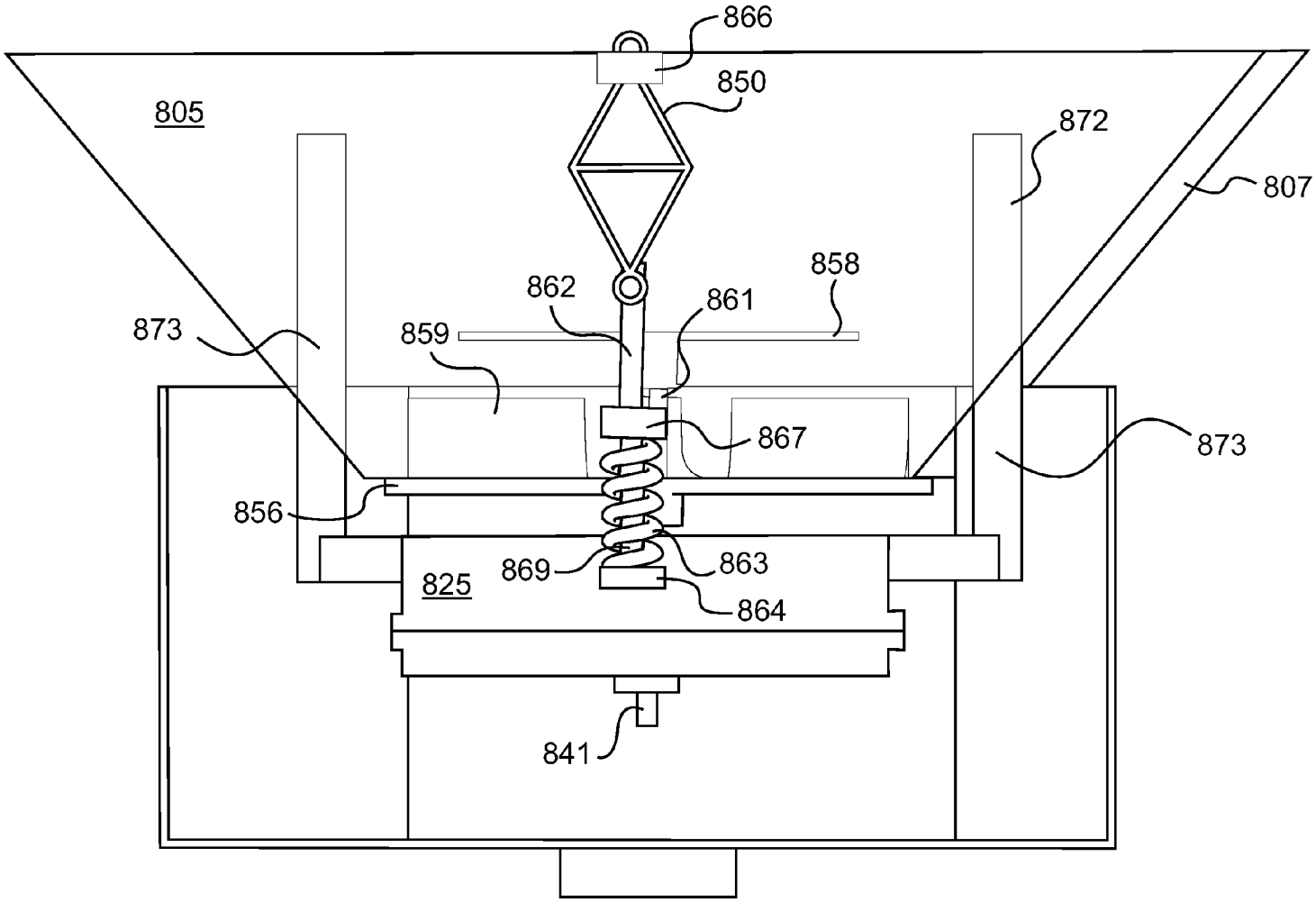
FIG. 8 shows a front perspective view of another exemplary embodiment of a backwall fire suppression system, in accordance with the present invention.

Turning to FIG. 8, a front perspective view of a back wall fire suppressor in accordance with another exemplary embodiment is shown. Elements drawn in lighter weight lines indicate elements hidden from view, within the hopper 805. A frangible link 850 is mounted on a front face of hopper 805. Gear box conduits 873 are shown disappearing into respective sides 807 of the hopper. Gear box conduits 873 fit into receiving conduits 872. Spinner blades 859, agitator 858, and drive shaft 861 are shown in hidden lines, being within the hopper. The gear box 825 and spinner 856 are shown in the up and loaded position. A connector 866 secures a top end of the frangible link 850 to the hopper 805. A bottom end of the frangible link connects to trigger shaft 862, connection not shown. An outer trigger shaft 862 fits over an inner trigger shaft 869. Stop 867 is affixed to the outer trigger shaft 862. A bottom end of shaft 869 is affixed to a connector 864. Connector 864 is affixed to the gear housing 825 and also provides the other stop for spring 863. Compression spring 863 fits over shafts 869 and 862 and is compressed between stops 864 and 867. When link 850 breaks, compressed spring 863 assists in lowering the gear box 825 and spinner assembly 856. As described above, lowering of the gear box frees the drive shaft 861 and spinner 856 to rotate due to a loaded power spring, not shown.

Spur gear shaft 841 is shown in the foreground and is used in operation to load the power spring, not shown. A drive shaft 861 is driven via the spur gear and pinion gear, not shown, to rotate the agitator 858 and spinner blades 859. FIG. 8 shows the gear box and spinner assembly in their raised position.

Figure 9:
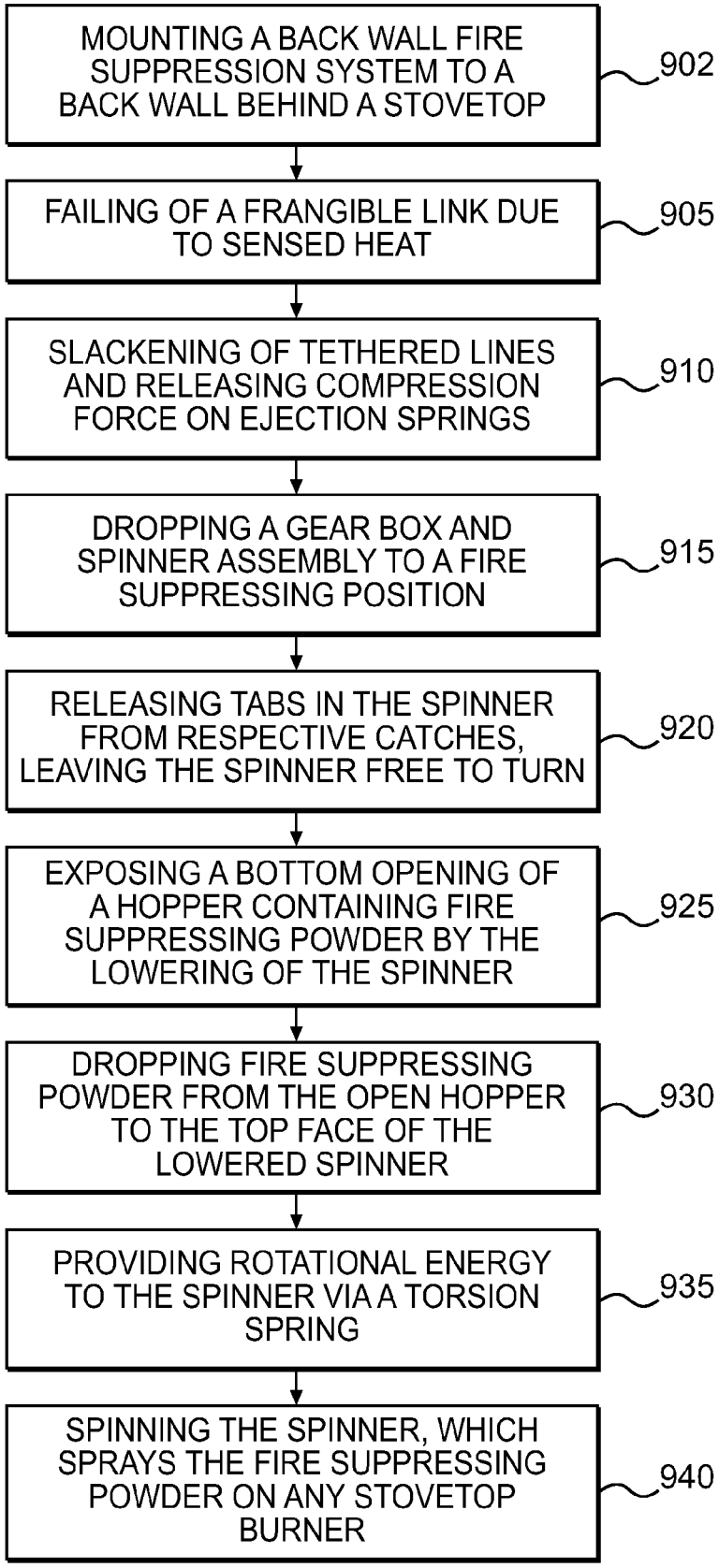
FIG. 9 shows an exemplary method of stovetop fire suppression using back wall fire suppression, in accordance with an embodiment of the present invention.

FIG. 9 shows an exemplary method of stovetop fire suppression using a back wall fire suppression system, in accordance with an embodiment of the present invention. A back wall fire suppression system, in accordance with an embodiment of the present invention, is mounted to a back wall behind a stovetop 902 to be protected. With the rising of local heat, a frangible link fails due to sensed heat 905. Tethered lines slacken and release compression force on ejection springs 910. A gear box and spinner assembly drop to a fire suppressing position 915. Tabs in the spinner release from a catch leaving the spinner free to turn 920. The lowered spinner exposes a bottom opening in a hopper containing fire suppressant powder 925. The fire suppressing powder begins dropping out of the hopper onto the top of the lowered spinner 930. A power spring provides rotational force to the now free spinner 935, which spins and sprays the fires suppressing powder across the stovetop surface, extinguishing a fire on any stovetop burner 940.

The present invention affords easy installation on the back wall above the stovetop. The fire suppression system does not interfere with lights or vents and does not interconnect with hoods or microwaves. The system is self contained, relying on the stored energy of a power spring to supply spinner driving power. And the system is automatic, with fire suppression triggered by the failing of a frangible link. In a design verification application, a single back wall fire suppression system embodiment was mounted on a back wall behind and above a stove top and centered between left and right burners. The fire suppressor, was able to spread fire suppression powder across a conventional stovetop, which was able to put out fire from a quarter inch of peanut oil in an eight to twelve inch pan on any burner.

Figure 10A:
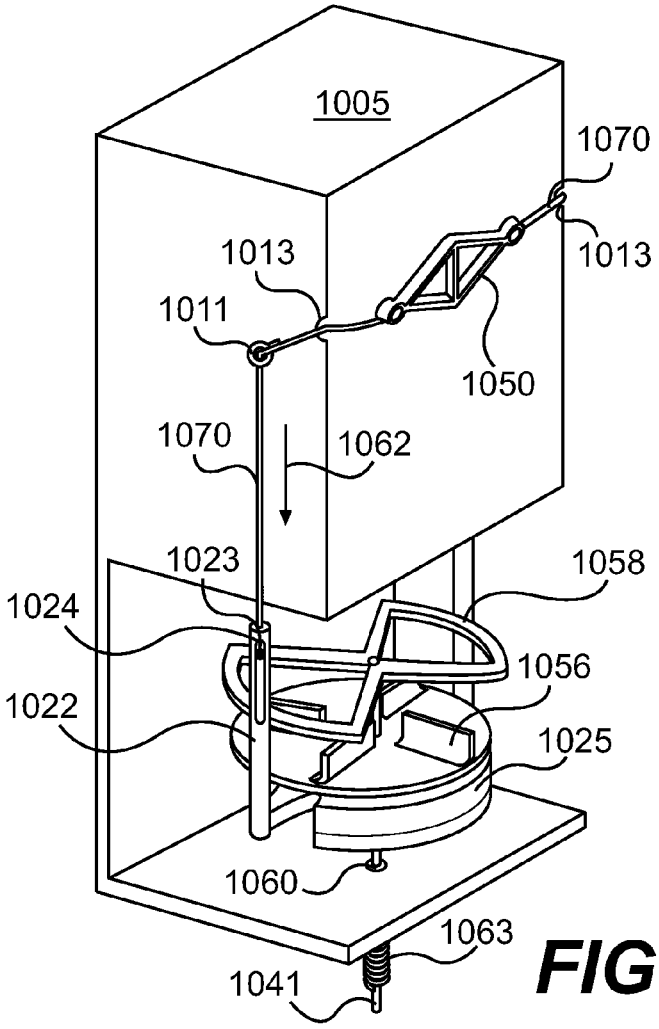
FIG. 10A shows a back wall fire suppresser system, in accordance with another exemplary embodiment of present invention.
Figure 10B:
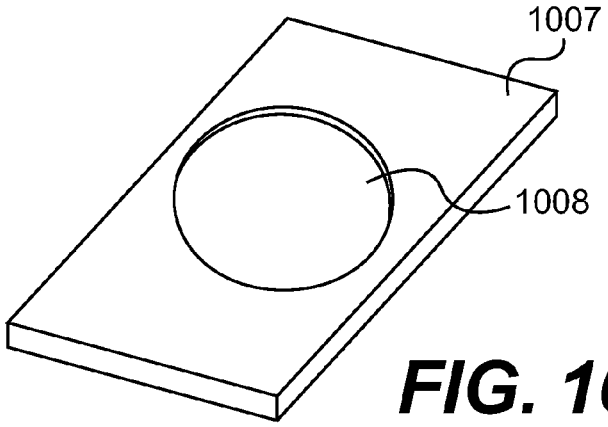
FIG. 10B shows a bottom view of the hopper shown in FIG. 10A.

FIG. 10A shows a back wall fire suppresser system, in accordance with another exemplary embodiment of present invention, and FIG. 10B shows a bottom view of the hopper shown in FIG. 10A. Hopper 1008, shown in FIG. 10A, is a rectangular prism shape containing fire suppressing powder. A frangible link 1050 is mounted across the front face of the hopper 1008. The back face of the hopper, not shown, mounts up against the vertical surface, the back wall or back splash via a back wall mount, not shown. Cables 1070 may connect to either side of link 1050 and ride in opposing notches 1013 at opposing front face edges. The cables may then thread through respective eyes 1011 before connecting to suspension bars 1022. Upon failure of the frangible link 1050, the suspension bars drop downwards 1062, as limited by the stop pin 1023 and slot 1024. Failure of the frangible link 1050 is not shown. In FIG. 10A, the lowered position of the gearbox 1025 and spinner assembly 1056 is shown at a greater displacement than afforded by the slot 1024, for illustrative purposes. The spinner assembly drops 1062 upon failure of the frangible link 1050. The suspension bars connect to a gear box housing 1025. Shown above the gear box housing 1025 are spinner 1056 and agitator 1058, both connect axially to a drive shaft, which extends out of the gear box. FIG. 10B shows a view of the bottom face 1007 of the exemplary hopper of FIG. 10A. The hopper has a round bottom opening 1008, which is sealed by the spinner 1056, when the suspension bars are in the up position. The notch 1013 and eyelet 1011 serve as guides for the cables 1070 and their purpose may be provided by alternate means across other embodiments.

In this embodiment, a compression spring 1063 is beneath bottom shroud 1010 resting against 1010 on the top and connecting to shaft 1041 on its other end. Shaft 1041 is turned by a user to load a power spring, not shown. A user loads the power spring via 1041 and raises the gear box to lock the drive shaft in position and compressing spring 1063 before releasing 1041. Similar to embodiments described above, the loaded shaft and spinner are prevented from turning when raised into the hopper. The notch and pin mechanism which prevent rotation in the up position are not shown. Once the hopper is loaded with fire suppressing powder matter, the power spring is loaded, and the gear box is raised to hold the drive shaft's axial position, then the fire suppression system can be easily mounted on a back wall above a stovetop. In still other embodiments the heat sensitive link may be mounted on a bottom face of the back wall fire suppression system, a pulley configuration can be utilized to suspend and lower the gear box and spinner assembly.

Figure 11:
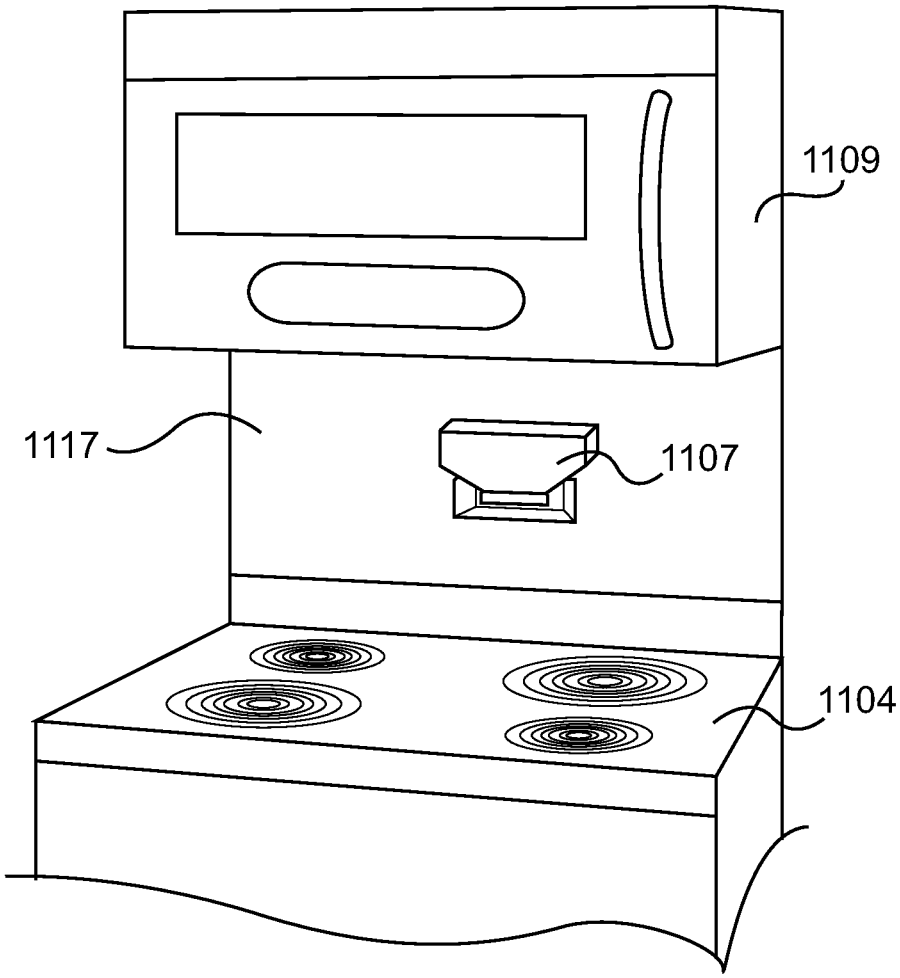
FIG. 11 shows a back wall fire suppresser system mounted on a back splash above a stovetop and beneath a microwave, in accordance with an embodiment of a back wall fire suppression system and method of the present invention.

FIG. 11 shows a back wall fire suppresser system mounted on a back splash above a stovetop and beneath a microwave, in accordance with an embodiment of a back wall fire suppression system and method of the present invention. A back wall fire suppression system 1107 is shown mounted on a back splash 1117 above a stovetop 1104 and beneath a microwave 1109.

While specific alternatives to steps of the invention have been described herein, additional alternatives not specifically disclosed but known in the art are intended to fall within the scope of the invention. Thus, it is understood that other applications of the present invention will be apparent to those skilled in the art upon reading the described embodiment and after consideration of the appended claims and drawing.

What is claimed is:

1. An automatic fire suppression system, the system comprising:

a back surface mounting plate;

a base affixed to the back surface mounting plate, the base comprising a back wall, a left wall, a right wall, a bottom shroud, and an open front face, wherein the left wall, the right wall, and the back wall connect to a respective edge of the bottom shroud;

a hopper, which stores contents comprising fire suppressing matter, connected to the base;

a spinner, which is connected to a shaft and which expels fire suppressing matter out of the open front face of the base; and a thermally activated self releasing mechanism, which activates upon sensing a specified temperature and triggers fire suppression action.

2. An automatic fire suppression system, the system comprising:

a back surface mounting plate;

a base affixed to the back surface mounting plate, the base comprising a back wall, a left wall, a right wall, a bottom shroud, and an open front face, wherein the left wall, the right wall, and the back wall connect to a respective edge of the bottom shroud;

a hopper, which stores contents comprising fire suppressing matter, connected to the base;

a spinner, which is connected to a shaft and which expels fire suppressing matter out of the open front face of the base; and a frangible link, which fails upon sensing a specified temperature and triggers fire suppression action.

3. The automatic fire suppression system of claim 2, further comprising:

a gear box beneath the hopper, wherein when the frangible link fails, the gear box lowers to the bottom shroud of the base and the spinner activates.

4. The automatic fire suppression system of claim 3, wherein:

the gear box is displaced from the bottom shroud when the automatic fire suppression system is loaded; and the spinner seals a bottom opening of the hopper when the automatic fire suppression system is loaded.

5. The automatic fire suppression system of claim 4, further comprising:

a first cable tied on one end to a first end of the frangible link and tied on another end to the gear box;

a second cable tied on one end to a second end of the frangible link and tied on another end to the gear box; and wherein the gear box is suspended via the first and second cables above the bottom shroud of the base.

6. An automatic fire suppression system, the system comprising:

a back surface mounting plate;

a base affixed to the back surface mounting plate, the base comprising a back wall, a left wall, a right wall, a bottom shroud, and an open front face, wherein the left wall, the right wall, and the back wall connect to a respective edge of the bottom shroud;

a hopper, which stores contents comprising fire suppressing matter, connected to the base;

a spinner, which is connected to a shaft and which expels fire suppressing matter out of the open front face of the base;

an agitator, which stirs the fire suppressing matter and assists in a flow of the fire suppressing matter;

a spur gear;

a pinion gear connected to the spur gear, wherein the spur gear and the pinion gear rotate in opposite directions; and a pinion shaft connected to the pinion gear, which turns the spinner and the agitator;

a gear box, which houses the spur gear and the pinion gear, comprising:

gear box conduits;

a top section; and a bottom section; and receiving conduits disposed in the hopper, which receive the gear box conduits, respectively.

7. The automatic fire suppression system of claim 6, further comprising:

receiving conduit springs disposed in respective receiving conduits, which are under compression between a top of a gear box conduit and a lip of a receiving conduit when the automatic fire suppression system is loaded.

* * * * *